US008225525B1

(12) United States Patent
Gallagher

(10) Patent No.: US 8,225,525 B1
(45) Date of Patent: Jul. 24, 2012

(54) WETSUIT CARRIER

(76) Inventor: R. Dennis Gallagher, Lake Arrowhead Villas, CA (US)

( * ) Notice: Subject to any disclaimer, the term of this patent is extended or adjusted under 35 U.S.C. 154(b) by 671 days.

(21) Appl. No.: 12/378,427

(22) Filed: Feb. 13, 2009

(51) Int. Cl.
*F26B 25/06* (2006.01)
*B65D 85/20* (2006.01)
*B65D 85/18* (2006.01)
*A01F 25/12* (2006.01)

(52) U.S. Cl. ..... 34/202; 34/201; 34/239; 34/240; 206/315.1; 206/288; 206/289

(58) Field of Classification Search ..... 34/239, 34/201, 103, 104, 240; 206/315.1, 315.11, 206/288, 286, 287, 287.1, 289, 278, 279, 206/98, 291; 223/120, 85, 92; 211/172; 312/123, 139.1, 282, 292; 190/13 R, 14, 190/15 R, 16, 18 R
See application file for complete search history.

(56) References Cited

U.S. PATENT DOCUMENTS 1,794,653 A * 3/1931 Storch ..... 312/276
4,949,842 A * 8/1990 Mokiao, II ..... 206/286
4,997,000 A 3/1991 Feast et al.
5,123,377 A * 6/1992 Edwards ..... 119/28.5
5,323,897 A 6/1994 Sperber
5,447,216 A 9/1995 Freyvogel
7,628,281 B2 * 12/2009 Sopel ..... 211/7
2002/0053575 A1 * 5/2002 Oliver ..... 220/835
2009/0025248 A1 * 1/2009 Lannon ..... 34/196

* cited by examiner

*Primary Examiner* — Kenneth Rinehart
*Assistant Examiner* — John McCormack
(74) *Attorney, Agent, or Firm* — James A. Quinton

(57) ABSTRACT

A wetsuit drying and transportation carrier includes a container having a wetsuit receiving interior. A reservoir is provided adjacent to the bottom of the container to receive liquid from the interior of the container. A first wetsuit support is pivotably connected to the container to pivot into and out of the container interior. A second wetsuit support is pivotably connected to the container in front of the first wetsuit support to pivot into and out of the interior of the container. A wetsuit shoulder support is connected to the container or to the first wetsuit support. A third wetsuit support is pivotably connected to the first and second wetsuit supports. The third wetsuit support desirably has a slot for receiving a wetsuit for drying and transportation.

18 Claims, 19 Drawing Sheets

WETSUIT CARRIER

FIELD OF THE INVENTION

The field of the invention is carriers for wet articles particularly wetsuits.

BACKGROUND OF THE INVENTION

Wetsuits are often used in water sports particularly in cool water or cool weather conditions. Often conditions for the water sport i.e. surfing is best early in the morning before work or school. After participation in the sport, the wetsuit needs to be dried. This has been problematic since the wetsuit is often dumped in a bucket, hung on a bush or fence in the sun after use. The wetsuit is often transported in the trunk or backseat of a car in an open container or in no container at all. Prolonged exposure of the wetsuit to the sun can result in UV damage to the wetsuit. The open transportation can result in water damage to the car interior.

Efforts have been made to provide carriers for wetsuit and diving gear. Wetsuit carriers have been proposed with reservoirs to catch dripping water. See for example U.S. Pat. Nos. 5,323,897 (Sperber) and 4,949,842 (Mokiao). Other carriers have been proposed which can also accommodate air tanks and other dive gear. See U.S. Pat. No. 5,447,216 (Freyvogel). Devices for washing and drying wetsuits have been proposed. See U.S. Pat. No. 4,997,000.

There is still a need for a wetsuit carrier that will efficiently promote the drying process prior to leaving the beach and drying transport of the wetsuit thereafter.

SUMMARY OF THE INVENTION

According to the invention, a wetsuit drying and transportation carrier is provided. The device includes a container having a wetsuit receiving interior. The container has an opening to the interior of the container. Desirably a reservoir is provided adjacent to the bottom of the container to receive liquid from the interior of the container. A first wetsuit support is pivotably connected to the container to pivot into and out of the container interior. A second wetsuit support is pivotably connected to the container in front of the first wetsuit support to pivot into and out of the interior of the container. A wetsuit shoulder support is connected to the container or to the first wetsuit support. A third wetsuit support is pivotably connected to the first and second wetsuit supports. The third wetsuit support desirably has a slot for receiving a wetsuit for drying and transportation.

In operation the wetsuit carrier has a pretransport drying mode and a transport mode. In the pretransport drying mode, the first and second wetsuit supports are pivoted out of the interior of the container. The third support is pivoted away from the first and second support. A wetsuit is mounted on the shoulder support so that the support engages the wetsuit shoulders by pulling the shoulder support through the neck opening of the wetsuit. The wetsuit is then laid on the first wetsuit support. Next the wetsuit is desirably placed into the slot in the third wetsuit support. The carrier can be desirably mounted on a vertical support e.g. a fence or an open car window. The wetsuit is suspended above the ground by the wetsuit carrier to begin drying prior to transport while the owner is still at the beach.

In the transport mode, the first wetsuit support is pivoted into the interior of the container. The third wetsuit support is pivoted into the interior of the container beside the first wetsuit support. The legs of the wetsuit are then engaged by the second wetsuit support.

The second wetsuit support is then pivoted into the interior of the wetsuit carrier container beside the first and third wetsuit supports. As a result, the wetsuit is folded into the interior of the container so that substantially each portion of the wetsuit is suspended in the container for drying during transportation.

The preferred embodiment of the present invention is illustrated in the drawings and examples. However, it should be expressly understood that the present invention should not be limited solely to the illustrative embodiment.

DETAILED DESCRIPTION OF THE INVENTION

Figure 1:
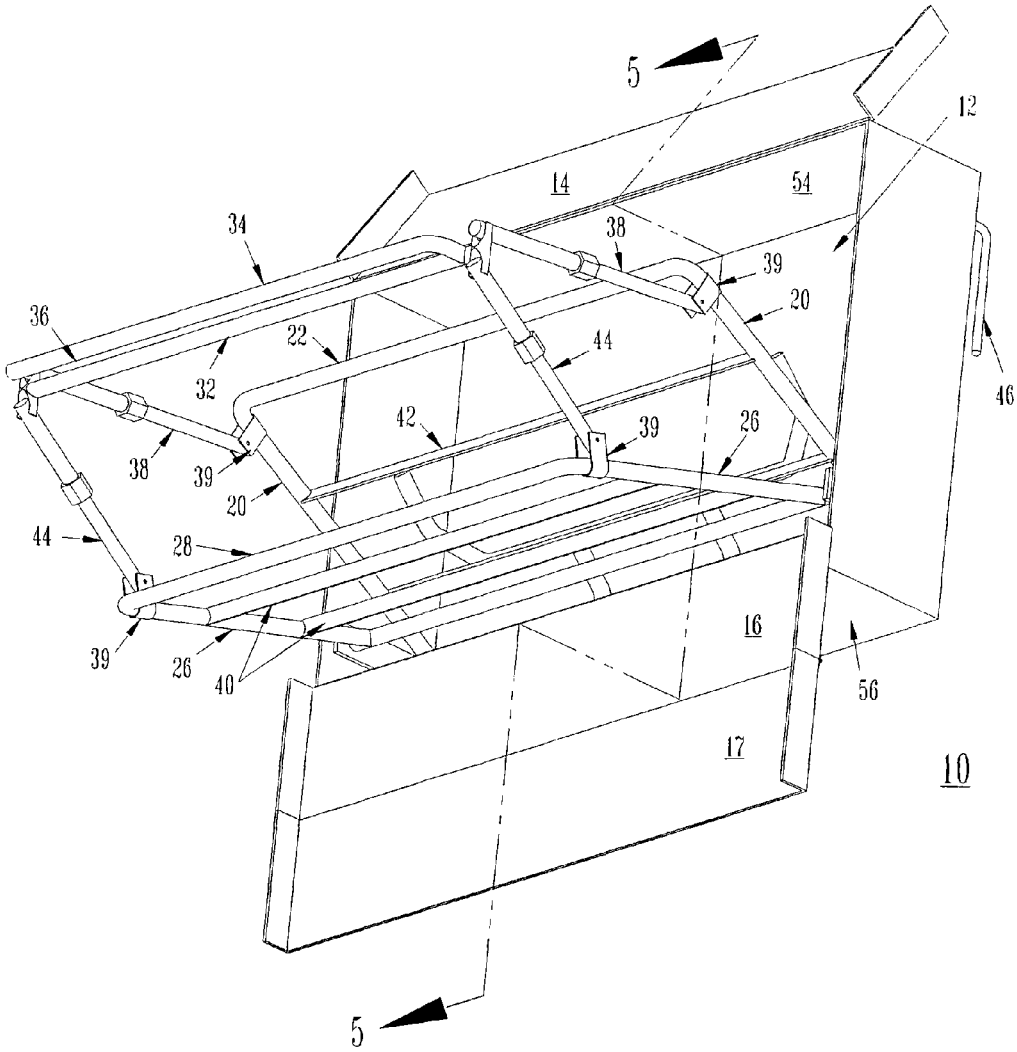
FIG. 1 is a perspective view of the wetsuit carrier according to the invention.

According to the invention, a wetsuit drying and transportation carrier is provided. The device includes a container having a wetsuit receiving interior. The container has a closable opening to the interior preferably in the front of the container to allow access to the container. Preferably the opening is water tight in the closed position and is closed off by a releasable cover. Desirably a reservoir is provided adjacent to the bottom of the container to receive liquid from the interior of the container through one or more openings in the bottom of the container interior. The floor of the interior of the container desirably has sloping walls to form a trough at the bottom of the container above the reservoir to direct water from the container interior to the reservoir. The trough desirably has one or more openings optionally two openings so water can flow from the container interior to the reservoir. Preferably the reservoir has one or more drains that can be selectively opened to remove water from the reservoir.

A first wetsuit support preferably generally rectangular in shape is pivotably connected to the container to pivot into and out of the container interior through the opening. A second wetsuit support preferably generally rectangular in shape is pivotably connected to the container in front of the first wetsuit support to pivot into and out of the interior of the container through the opening. The first and second wetsuit supports are desirably connected to the container adjacent the container floor. A wetsuit shoulder support is connected to the container or to the first wetsuit support. A third wetsuit support is pivotably connected to the first and second wetsuit supports. Desirably, a slot is provided in the third wetsuit support for receipt of a wetsuit for drying and transportation. Desirably the slot is open at one end. A closure mechanism desirably a pin or clip is preferably provided to close the slot at the open end and to retain a wetsuit in the slot and prevent the wetsuit falling out of the slot. Desirably the slot receives the wetsuit at about the midpoint of the wetsuit.

In operation the wetsuit carrier has a pretransport drying mode and a transport mode. In the pretransport drying mode, the first, second and third wetsuit supports are pivoted out of the interior of the container. The third support is pivoted away from the first and second support. A wetsuit is mounted on the shoulder support so that the support engages the wetsuit shoulders by pulling the shoulder support through the neck opening of the wetsuit. The wetsuit is then laid on the first wetsuit support. Next the wetsuit is placed on the third wetsuit support preferably through the slot. Preferably the midsection of the torso of the wetsuit extends through the slot. The carrier can be desirably mounted on a vertical support e.g. a fence or an open car window. The wetsuit is suspended above the ground by the wetsuit carrier to begin to dry prior to transport for example while the owner is still at the beach.

In the transport mode, the first wetsuit support is pivoted into the interior of the container. The third wetsuit support is pivoted toward the interior of the container beside the first wetsuit support. The legs of the wetsuit then engage the second wetsuit support. The second wetsuit support is then pivoted toward the interior of the wetsuit carrier container beside the third wetsuit support. As a result, the wetsuit is folded into the interior of the container so that substantially each portion of the wetsuit is suspended in the container for drying during transportation. Preferably the wetsuit is folded three times to about one quarter of the size of the wetsuit. Desirably, each folded portion is spaced apart from the adjacent folded portion to enhance drying. As a result the wetsuit is compactly stowed away for transport and drying. Desirably, in the transport mode, the space between the supports is minimized.

Referring now to the drawings as best seen in FIGS. 1 to 9, a first embodiment of a wetsuit drying and transportation apparatus according to the invention is provided. The apparatus includes a container 10 having a wetsuit receiving interior 12. The container includes an opening in the front which is closed off by a releasable cover, desirably a one or two piece cover, optionally three piece cover having a top 14 and a two piece bottom 16 and 17. The releasable cover opens to expose the wetsuit receiving interior 12. Covers top and bottom are desirably connected to container 10. The bottom cover can be formed by connecting 16 and 17 together. Preferably, the releasable cover is water tight upon closing. The container 10 includes a container top 54 and a container bottom 56. The container also has a container right side 58 and container left side 60. The wetsuit receiving interior is accessed by opening the releasable top and bottom covers.

Preferably, the container 10 has an attached reservoir 50 which is in fluid communication with the wetsuit receiving interior 12. Desirably, the floor of the wetsuit receiving interior has a drain 70 optionally two (2) or more drains in the floor that connect the container floor to the reservoir 50 to allow water to pass from the container interior 12 to the reservoir 50. Desirably, the container floor has two (2) sloping walls 68 that form a trough to direct the water dripping from the wetsuit into the container interior 12 to the trough and ultimately through the floor drain 70 to the reservoir 50. Reservoir 50 has a drain 72 that can be opened to remove liquid from the reservoir 50.

A first wetsuit support is provided. The first wetsuit support is preferably generally rectangular and as shown in FIGS. 1 to 9 can be composed of vertical bars 20 and horizontal bars 22. Optionally, as will be described in regard to FIGS. 10 to 19, the first wetsuit support can be a substantially solid preferably rectangular support 102. First wetsuit support includes one or more wetsuit separators 42. The first wetsuit support is pivotally connected to the container 10 to pivot into and out of the wetsuit receiving interior 12. Desirably, the first wetsuit support is pivotally connected to the container adjacent to the reservoir 50. Desirably a plate, desirably a metal plate or a plastic plate 86 is secured to each side wall 58 and 60 above the reservoir 50. First wetsuit support desirable is pivotably connected to plates 86 at pivotable connection 88 to each plate. A second wetsuit support which is desirably generally rectangular in shape is provided. Optionally, the second wetsuit support is a substantially a solid preferably rectangular piece 110 as shown in FIGS. 10 to 19. As shown in FIGS. 1 to 9, the second wetsuit support is desirably formed of vertical bars 26 and horizontal bars 28. The second wetsuit support in the embodiment of FIGS. 1 to 9, desirably includes two (2) or more wetsuit separators, preferably two (2) wetsuit separators 40. The second wetsuit support is pivotally connected to the container 10 in front of the first wetsuit support and is preferably connected to the container 10 desirably adjacent to the floor. Desirably the second wetsuit support is pivotably connected to plate 86 on each side wall 58 and 60 at pivotable connection 90 so the support can move easily into and out of container 10.

A wetsuit shoulder support 80 is connected to the container 10 or optionally to the first wetsuit support. Desirably, the wetsuit shoulder 80 support has two (2) vertical projections 82 and 84 which pivot at the ends for passing through the neck of the wetsuit and engagement with the shoulders of the wetsuit to maintain the wetsuit in an extended and shaped position during transport or drying.

A third wetsuit support is provided desirably a single piece preferably having a slot. Optionally, as shown in FIG. 1, the third wetsuit support is formed by a first bar 32 which is connected to a second bar 34 which is spaced from the first bar 32 to provide a slot 36 which is open at one end for receipt of a wetsuit between the two bars. The third wetsuit support is connected to the first wetsuit support through two telescoping rods 38 and to the second wetsuit support through two telescoping rods 44. Optionally, a pin or clip is provided to close open end of slot 36.

Adjustable clamps 39 connect telescoping rods 38 and 44 to the first and second wetsuit support vertical bars 20 and 26. The distance of the third wetsuit supports when extended from the first and second supports can desirably be adjusted from a maximum when a long wetsuit is carried to a minimum when a short wetsuit is carried to an intermediate distance (see FIGS. 5 to 9). The distance can be varied depending on the length of the wetsuit. The clamps 39 can be moved up and down the first wetsuit support vertical bars 20 and the second wetsuit support vertical bars 26 to adjust the distance between the third wetsuit support and the first and second wetsuit supports depending on the length of the wetsuit.

Figure 2:
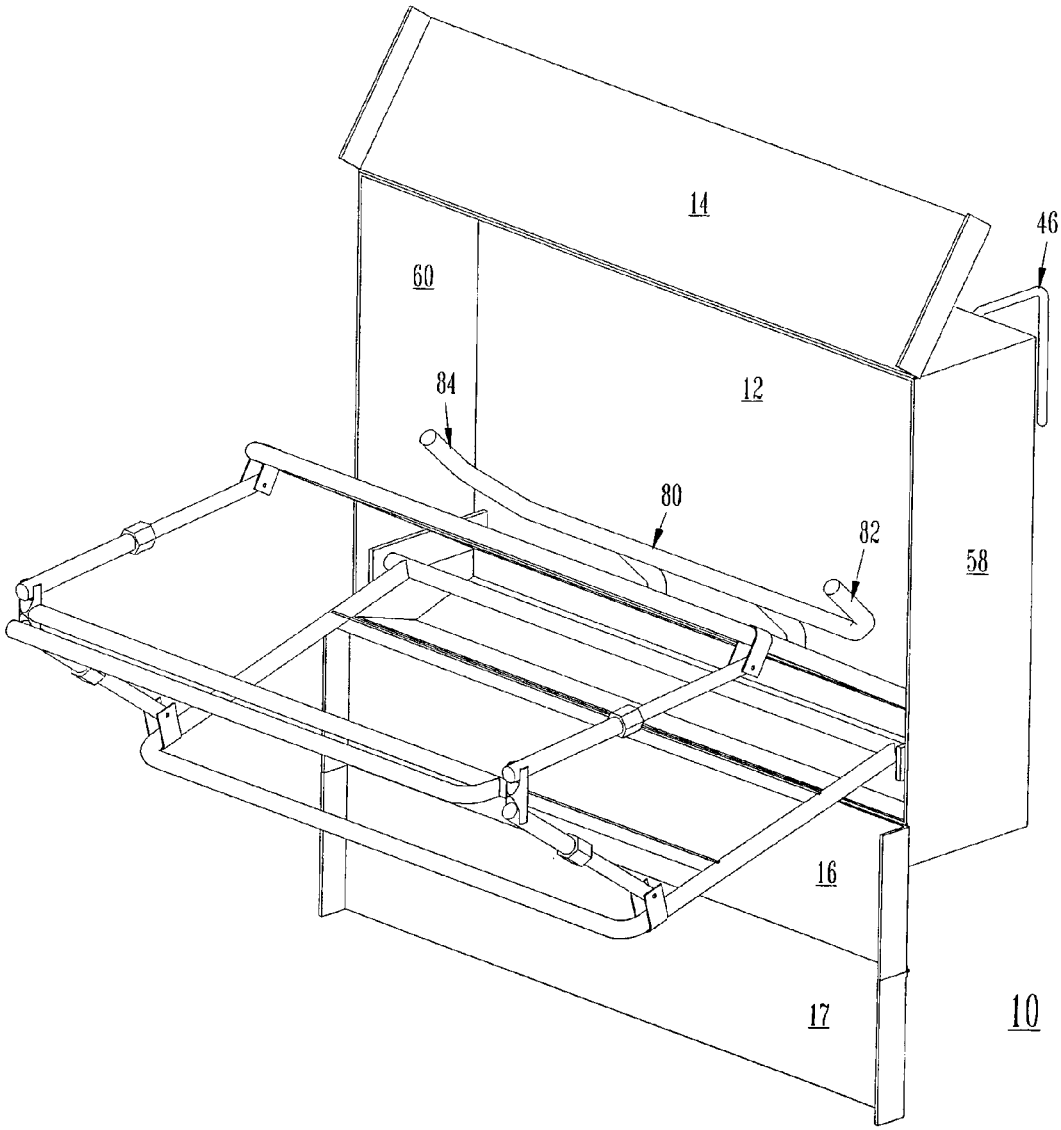
FIG. 2 is a perspective view of the wetsuit carrier according to FIG. 1 in the drying mode.
Figure 3:
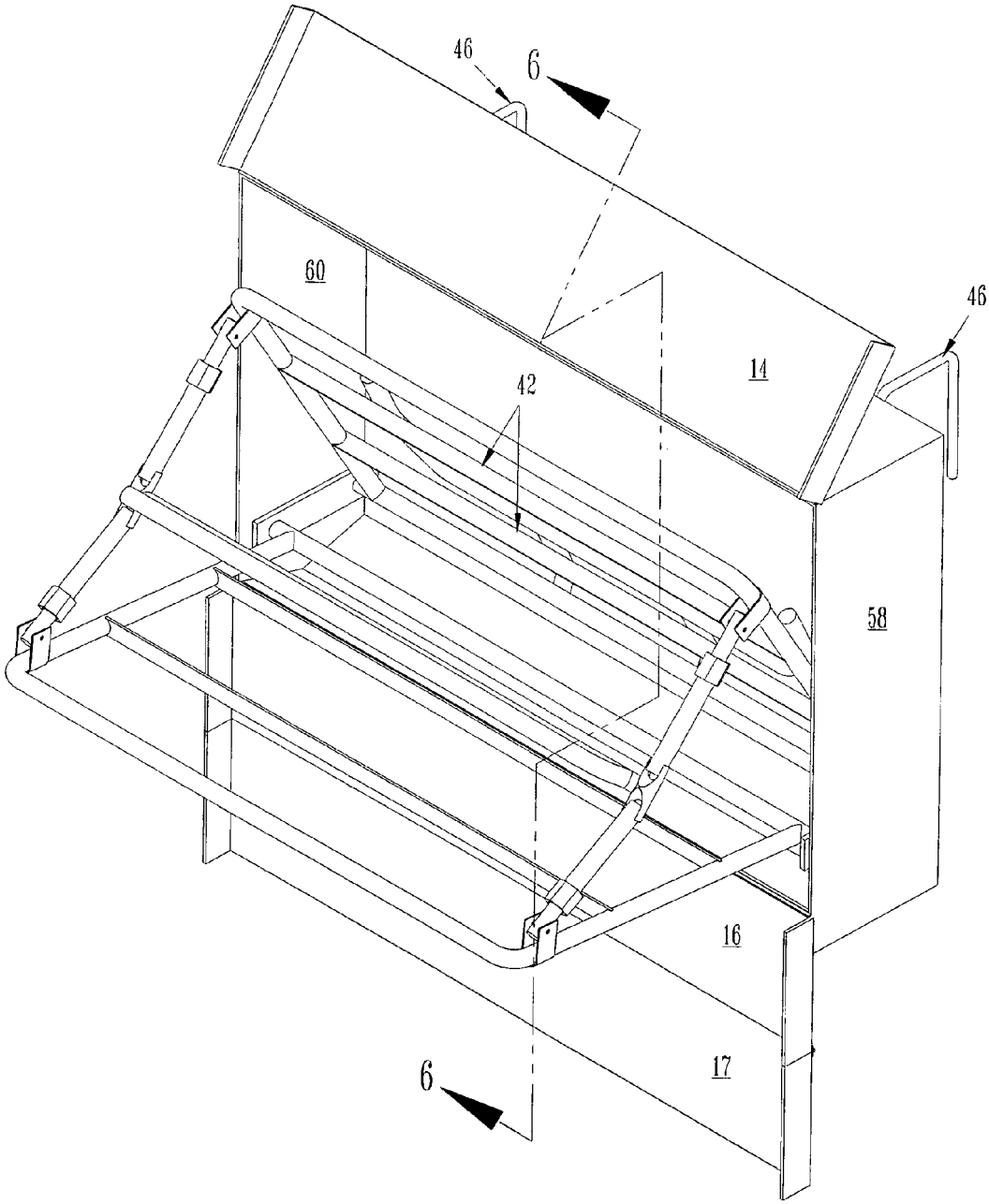
FIG. 3 is a perspective view of the wetsuit carrier according to FIG. 1 in between the drying and transport modes.
Figure 4:
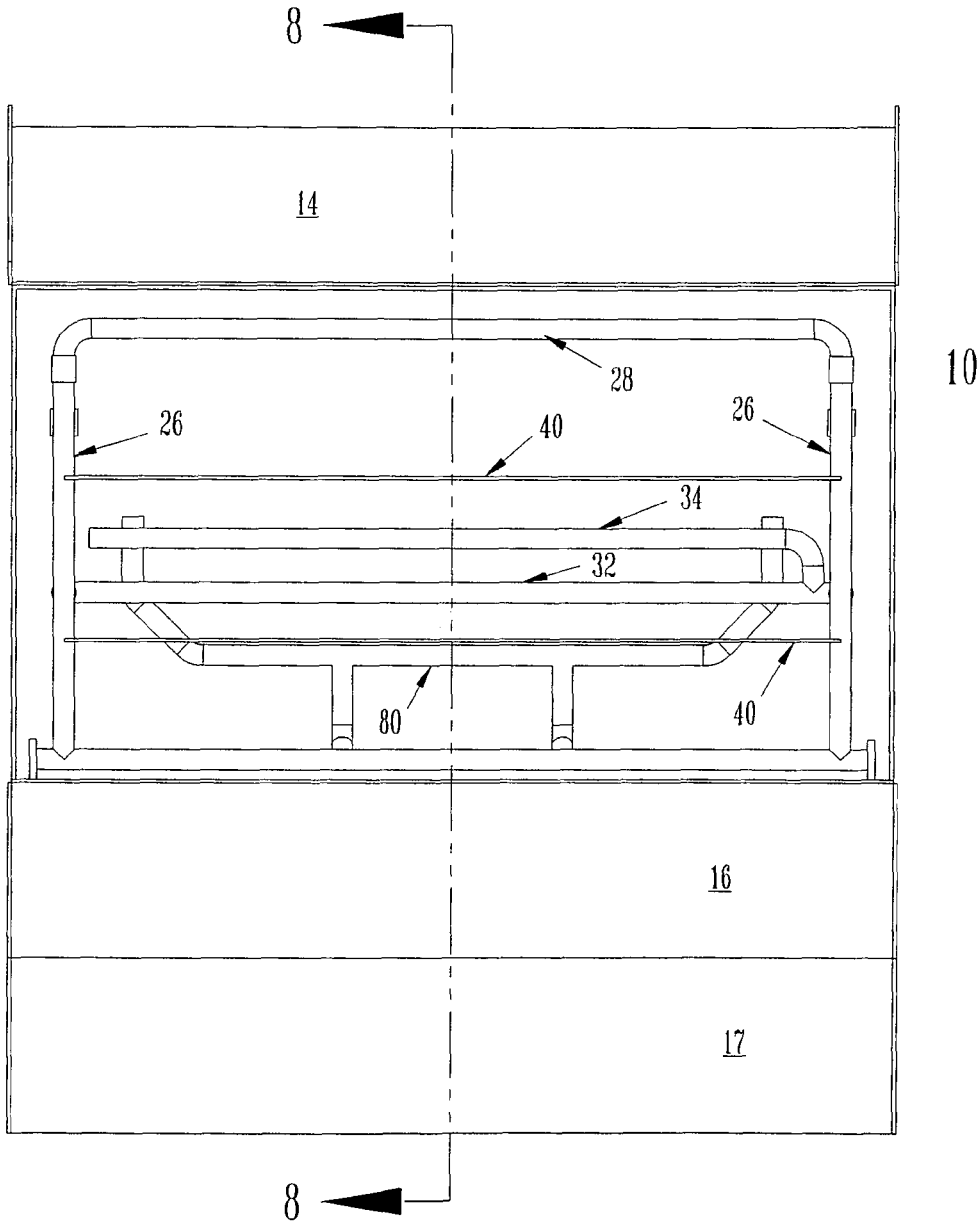
FIG. 4 is a front view of the wetsuit carrier according to FIG. 1 configured in the transport mode.
Figure 5:
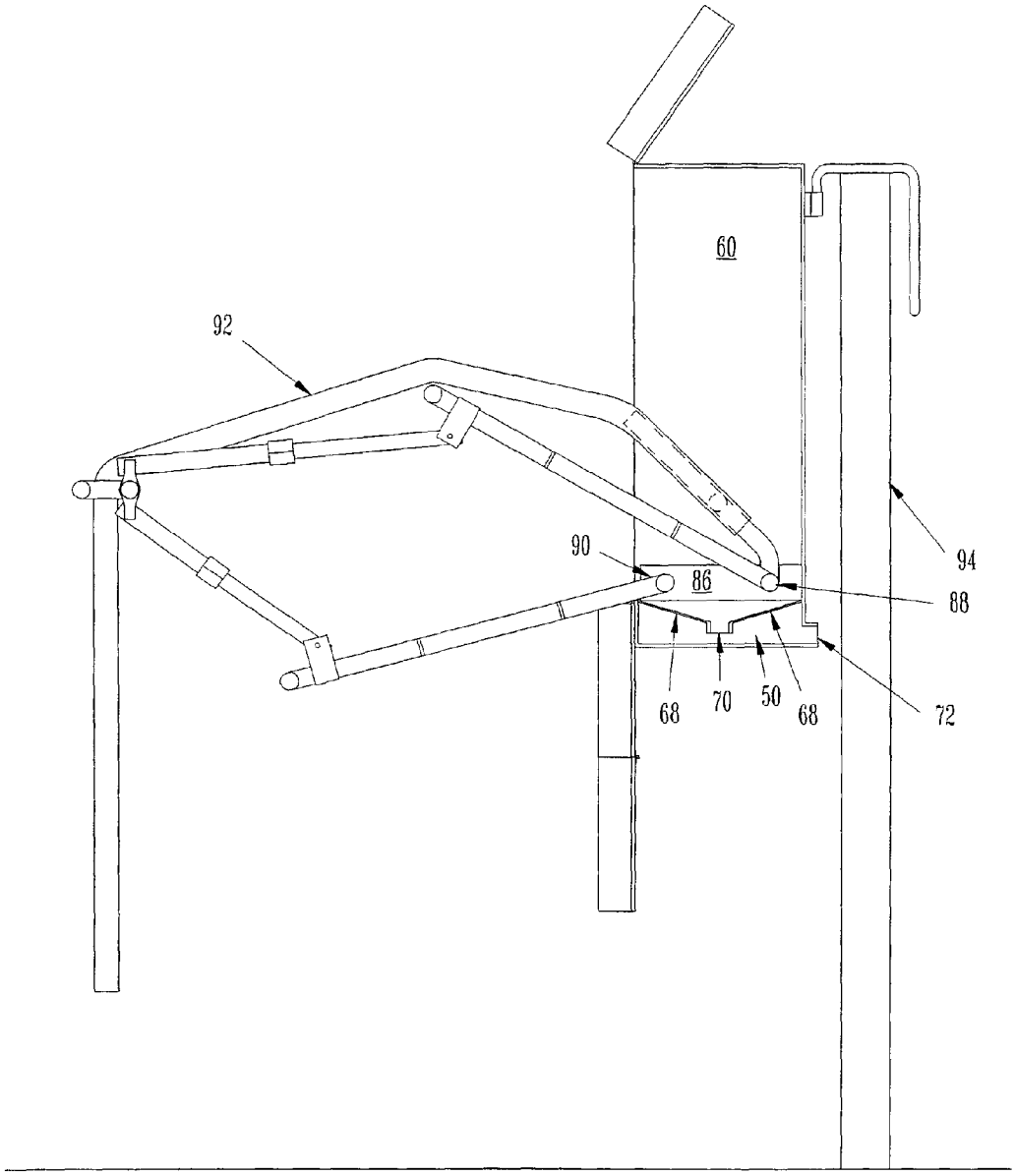
FIG. 5 is a sectional through 5-5 of the wetsuit carrier of FIG. 1 with long wetsuit mounted thereto and the carrier hanging from a support.
Figure 6:
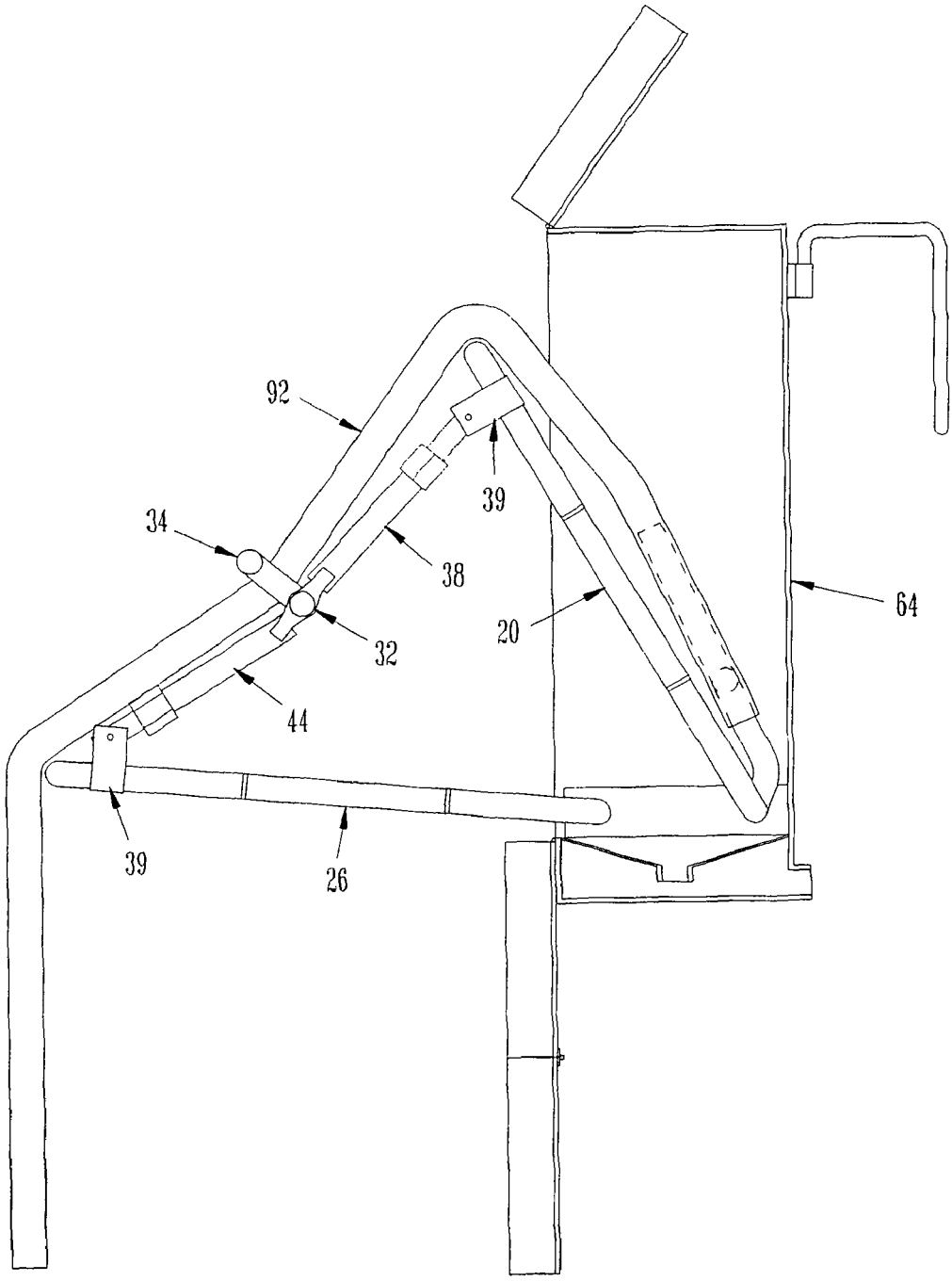
FIG. 6 is a sectional view through 6-6 of FIG. 3 adjusted for a medium sized wetsuit.
Figure 7:
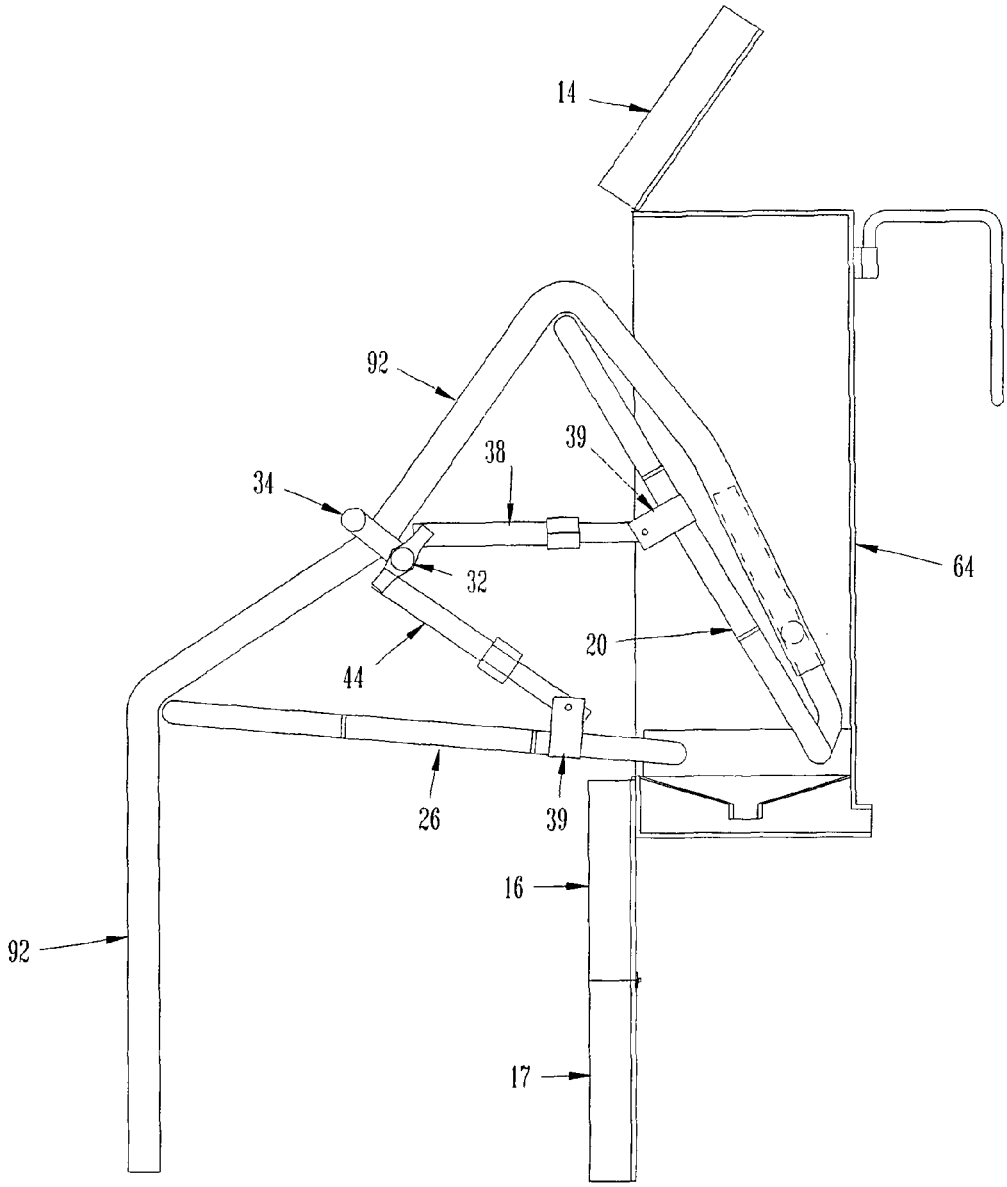
FIG. 7 is similar to FIG. 6 only adjusted for a short wetsuit.
Figure 8:
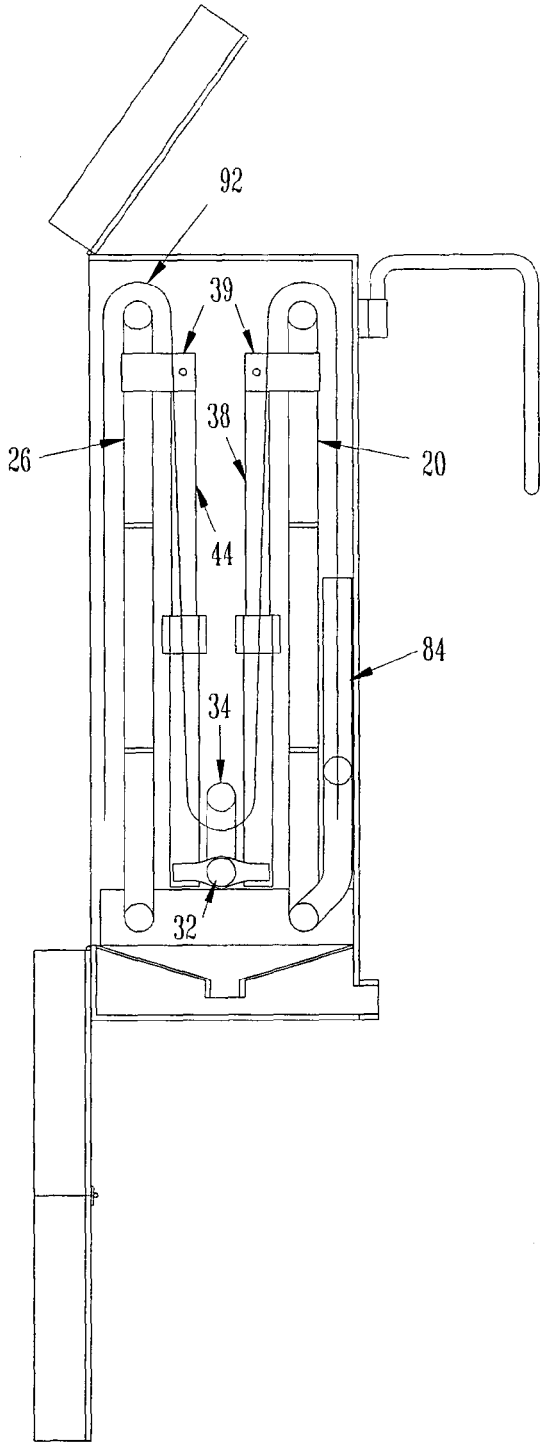
FIG. 8 is a sectional view through 8-8 of FIG. 4 with the carrier configured in the transport mode with a long wetsuit.
Figure 9:
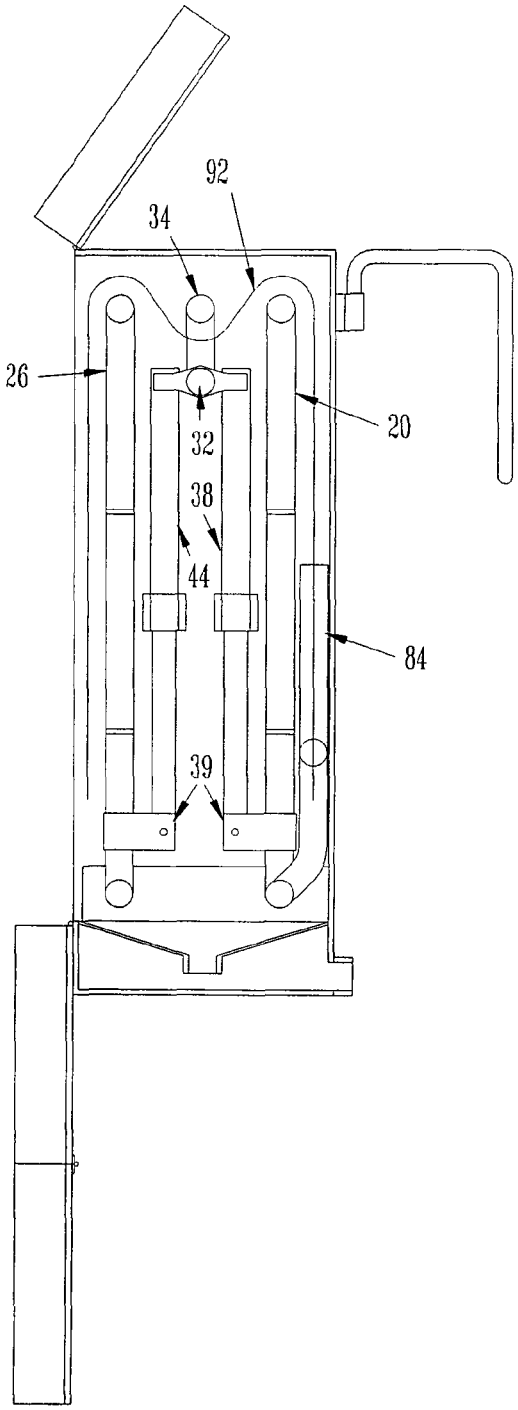
FIG. 9 is similar to FIG. 8 only with the carrier configured in the transport mode with a short wetsuit.
Figure 10:
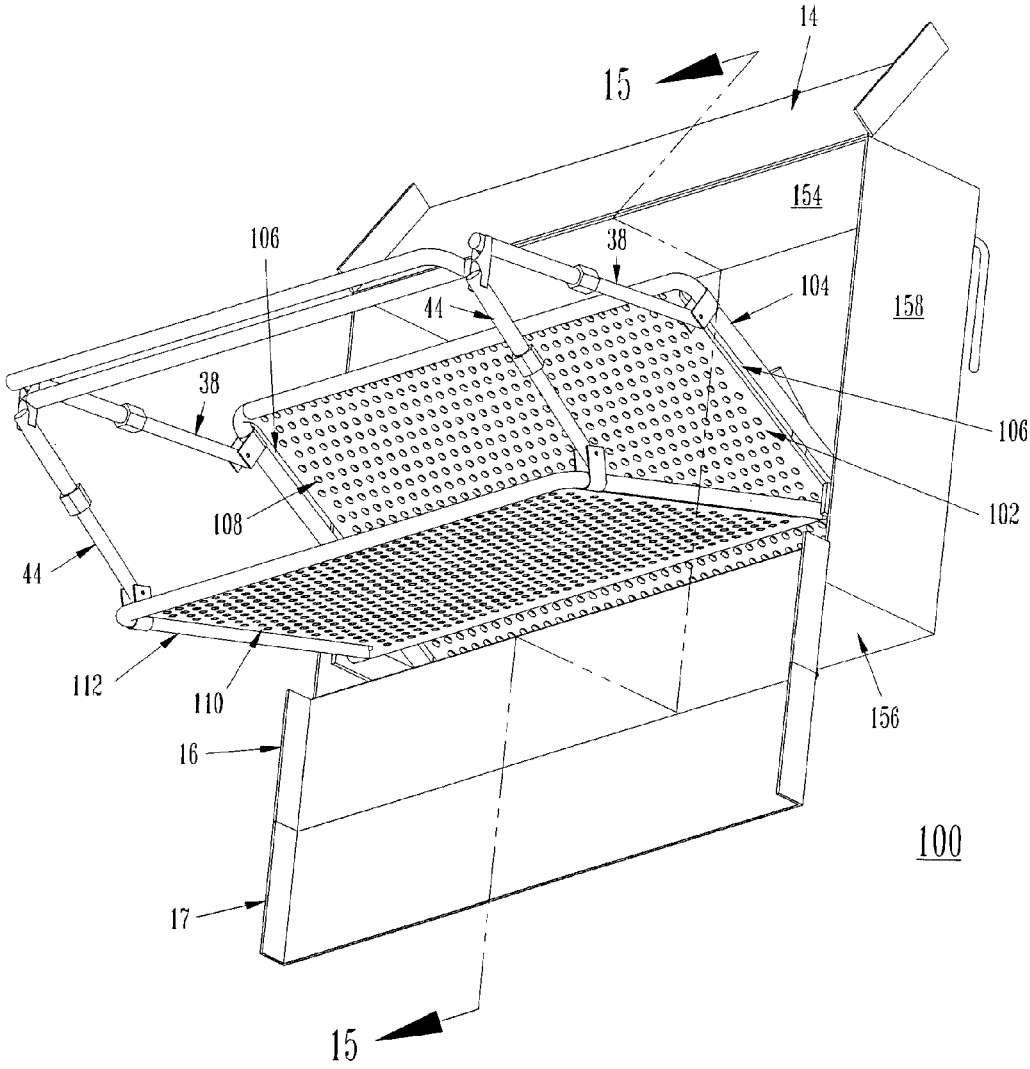
FIG. 10 is a perspective view of an alternative embodiment of a wetsuit carrier according to the invention.

The wetsuit carrying and drying apparatus has two (2) modes, a pretransport drying mode and a transport mode. As best seen in FIGS. 1 and 2, the pretransport drying mode, the first and second wetsuit supports are pivoted out of the wetsuit receiving interior 12. The third support is pivoted away from the first and second supports. The space between the third wetsuit support and the first and second support is adjusted depending on the size of the wetsuit by sliding adjustable connectors 39 up or down the rods 20 and 26. The wetsuit 92 is then mounted on the shoulder support 80. Vertical projections 82 and 84 of the shoulder support engage the shoulders of the wetsuit 92. The wetsuit is pulled across the first wetsuit support and then pulled through a slot 36 in the third wetsuit support. The legs of the wetsuit then are hanging down from the third wetsuit support, desirably, through the slot 36. As a result, when the container is hung from a support such as fence 94, the wetsuit 92 is suspended above the ground.

In the transport mode, the first wetsuit support is pivoted into the interior 12 of the container 10. The third wetsuit support is pivoted into the interior of 12 of the container 10 beside the first wetsuit support. The second wetsuit support is then pivoted into the interior 12 of container 10 beside the third wetsuit support. As a result the wetsuit 92 is folded into the interior 12 of the container 10 so that each section of wetsuit is suspended and separated from the adjoining folded portion for drying during transportation. Desirably, the wetsuit is folded 3 times to about one-quarter the size of the wetsuit.

In another aspect of the invention, the wetsuit transportation and drying apparatus includes a suspension system so that the container can be hung from a vertical wall or structure, particularly in the pretransport mode. Desirably, the suspension system includes two (2) spaced hangers 46 on the back 64 of the container 10 which are adapted to hang from a support e.g. window of an automobile or from a fence 94, a trunk of a car or other convenient vertical structure. Desirably, the wetsuit carrier is mounted to a support. The first and second support can be fully or partially extended from the interior 12 of the container 10. Desirably, during mounting of the wetsuit, the supports are fully extended. In the pretransport drying mode, the support can be moved to a partially extended position prior to hanging on a support to reduce the space taken up by the wetsuit supports extending from the container. Desirably, the hangers 46 are padded. In addition, the back 64 of the container 10 can be padded to minimize damage to painted surfaces during hanging.

As best seen in FIGS. 10 to 19, an alternative embodiment of the drying and transportation apparatus according to the invention is provided. The apparatus includes a container 100 having a wetsuit receiving interior 120. The container 100 has an opening in the front which is closed off by a releasable cover, desirably a one piece or two piece, optionally a three piece, cover having a top 14 and optionally a two piece bottom cover 16 and 17. The cover opens to expose the wetsuit receiving interior 120. Covers 14 and 16 are desirably connected by hinges to container 100. The bottom cover is optionally formed by 16 and 17 together so that cover 17 can be folded on top of cover 16 when hanging from a support to reduce the height required of the support to suspend the container above ground. Preferably, the releasable cover is water tight upon closing. The container includes a container top 154 and a container bottom 156. The container also has a container right side 158 and container left side 160. The wetsuit receiving interior is accessed by opening the releasable top and bottom covers.

Preferably, the container 100 has an attached reservoir 150 which is in fluid communication with the wetsuit receiving interior 120. Desirably, the floor of the wetsuit receiving interior has a drain 170 optionally two (2) or more drains in the floor that connect the container floor to the reservoir 150 to allow water to pass from the container interior 120 to the reservoir 150. Desirably, the container floor has two (2) slopping walls 168 that form a trough to direct the water dripping from the wetsuit into the container interior 120 to the trough and ultimately through the floor drain 170 to the reservoir 150.

A first wetsuit support desirably a panel 102 desirably a rectangular plastic panel desirably having a number of holes preferably perforations 108 through the support to allow air flow through the panel 102 are provided. The first wetsuit support 102 has a tubular shaped periphery 104. Vertical slots 106 are desirably located on either side of the panel 102. The first wetsuit support 102 is pivotally connected to the container 100 to pivot into and out of the wetsuit receiving interior 120. Desirably, the first wetsuit support 102 is pivotally connected to the container adjacent to the reservoir 150. Desirably, a plate, desirably a plastic or metal plate 86, is secured to each side wall 158 and 160 above the reservoir 150. First wetsuit support 102 is pivotally connected to plates 86 at pivotable connection 88 to each plate.

A second wetsuit support, desirably a panel, preferably a rectangular plastic panel 110 desirably having a number of holes preferably perforations 108 through panel 110 to allow air flow through the support is provided. The second wetsuit support 110 has a tubular shaped periphery 112. Vertical slots 114 are located on either side of the panel 110. The second wetsuit support 110 is pivotally connected to the container 100 in front of the first wetsuit support 102 and is connected to the container 100 desirably adjacent to the container floor. Desirably, wetsuit support 110 is pivotably connected to plate 86 on each side wall 58 and 60 at pivotable connection 90 so the support can move easily into and out of container 100.

A wetsuit shoulder support 80 in connected to the container 100 or optionally to the first wetsuit support. Desirably, the wetsuit shoulder 80 support has two (2) vertical projections 82 and 84 which pivot at the ends for passing through the neck of the wetsuit and engagement with the shoulders of the wetsuit to maintain the wetsuit in an extended and shaped position during transport or drying.

A third wetsuit support is provided desirably a single piece having a slot. Optionally, the third wetsuit support is formed by a first bar 32 which is connected to a second bar 34 which is spaced from the first bar 32 to provide a slot 36 which is open at one end for receipt of a wetsuit between the two bars. The third wetsuit support is connected to the first wetsuit support through two telescoping rods 38 and to the second wetsuit support through two telescoping rods 44.

Adjustable clamps 39 connect telescoping rods 38 and 44 to the first and second wetsuit supports 102 and 110. The distance of the third wetsuit support from the first and second supports can desirably be adjusted from a maximum (see FIG. 18) when a long wetsuit is carried to a minimum when a short wetsuit (see FIG. 19) is carried. The distance can be varied depending on the length of the wetsuit. The clamps 39 can be moved up and down the first wetsuit support vertical slot 106 and the second vertical slot 114 to adjust the distance between the third wetsuit support and the first 102 and second 104 wetsuit supports depending on the length of the wetsuit.

Figure 11:
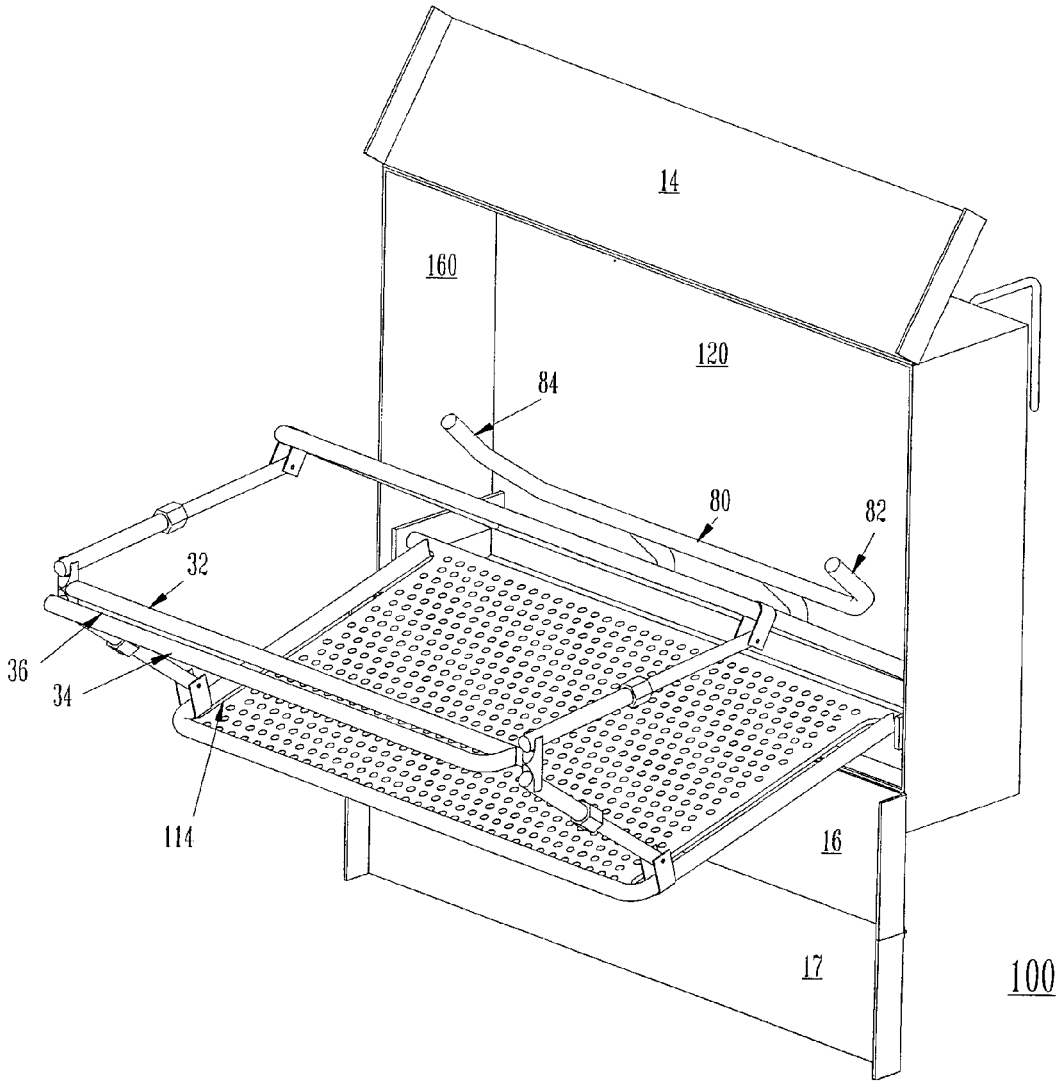
FIG. 11 is a perspective view of the wetsuit carrier according to FIG. 10 in the drying mode.
Figure 12:
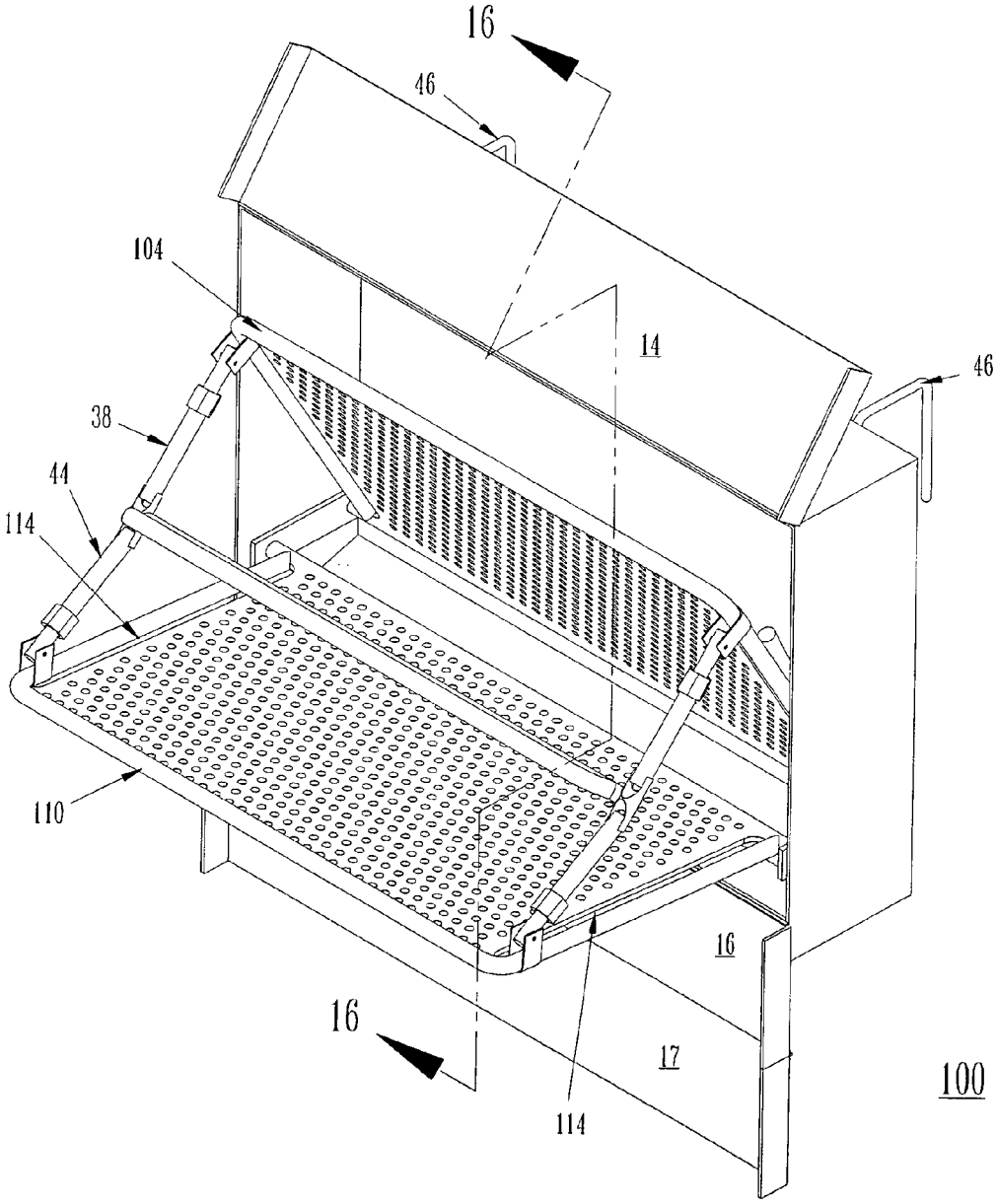
FIG. 12 is a perspective view of the wetsuit carrier according to FIG. 10 in between the drying and transport modes.
Figure 13:
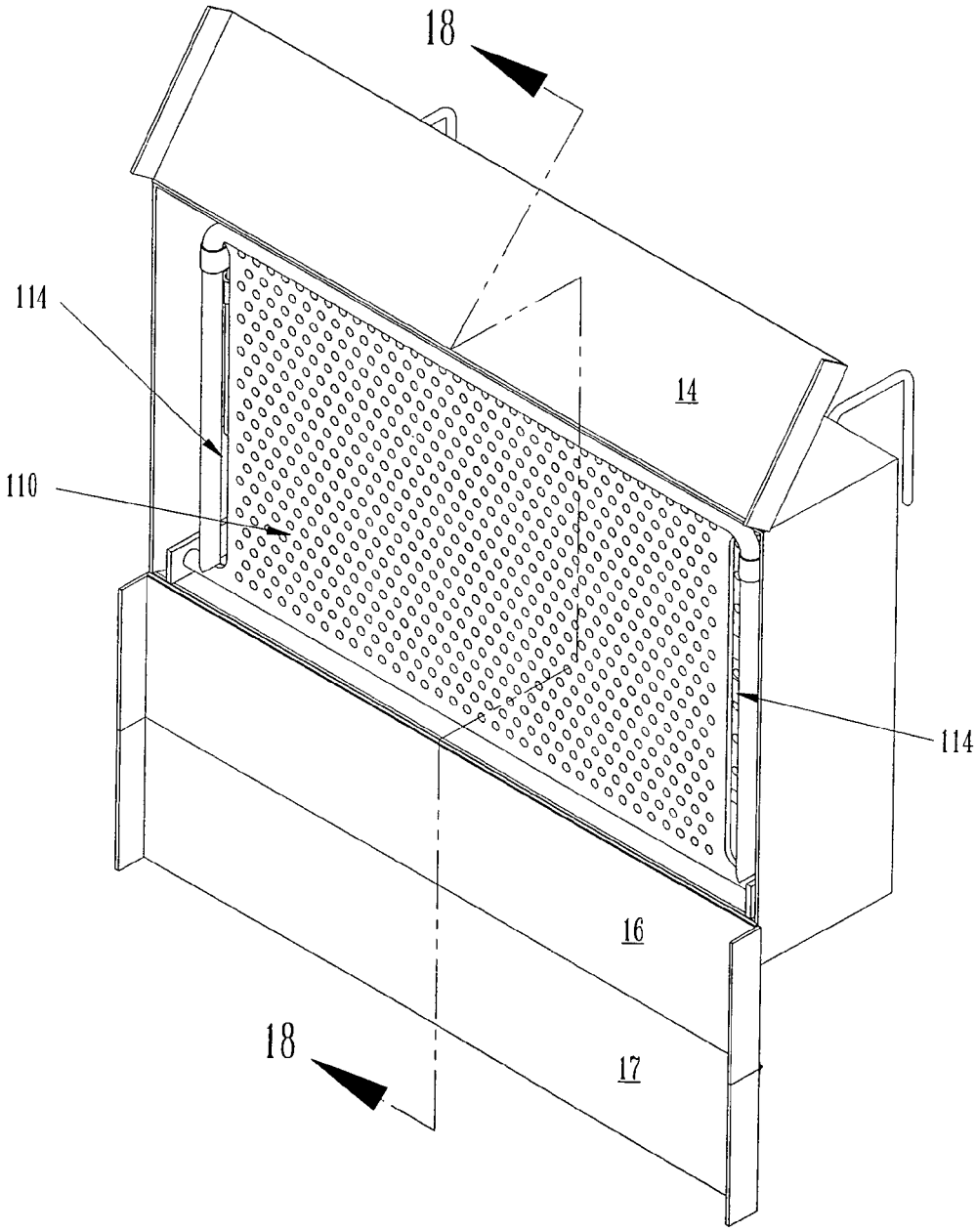
FIG. 13 is a perspective view of the wetsuit carrier according to FIG. 10 in the transport mode.
Figure 14:
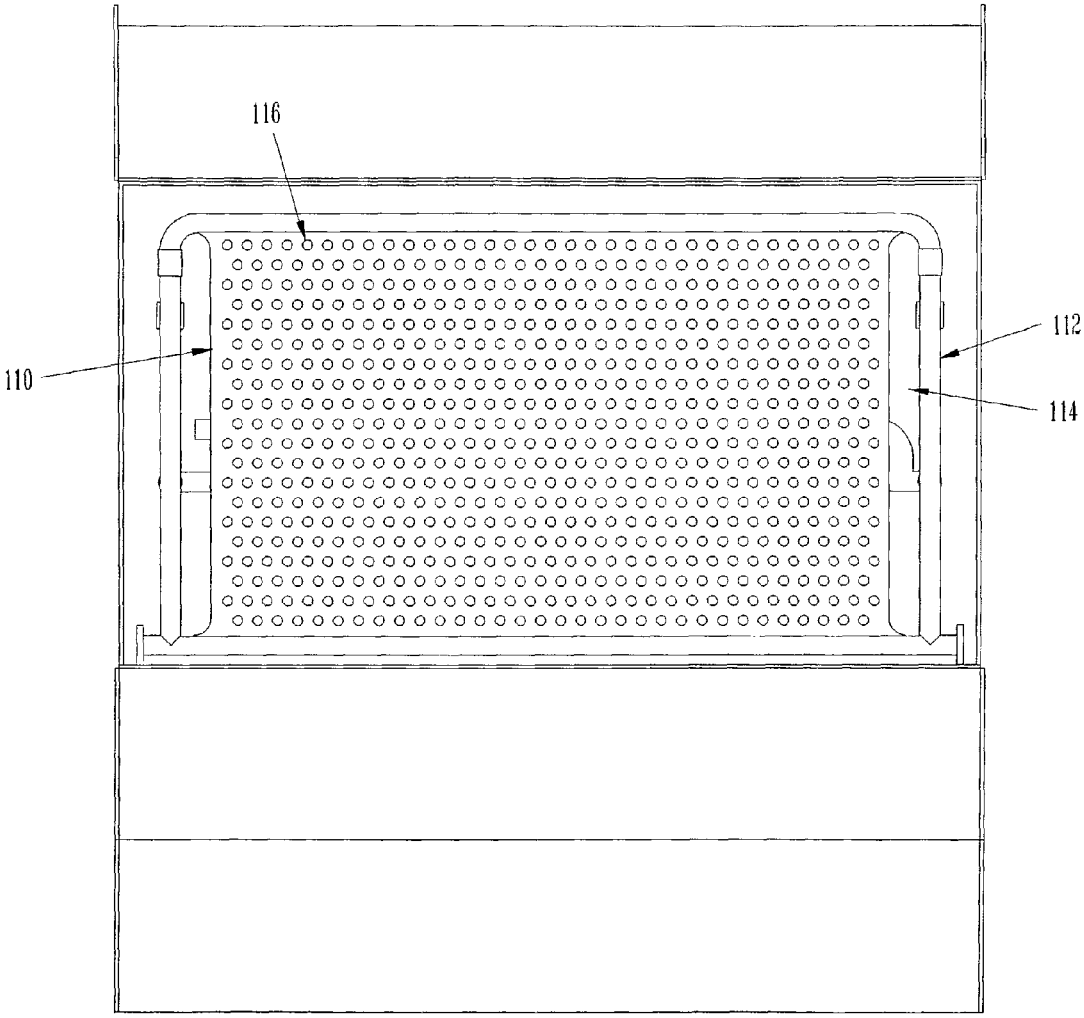
FIG. 14 is a front view of FIG. 13 in the transport mode.
Figure 15:
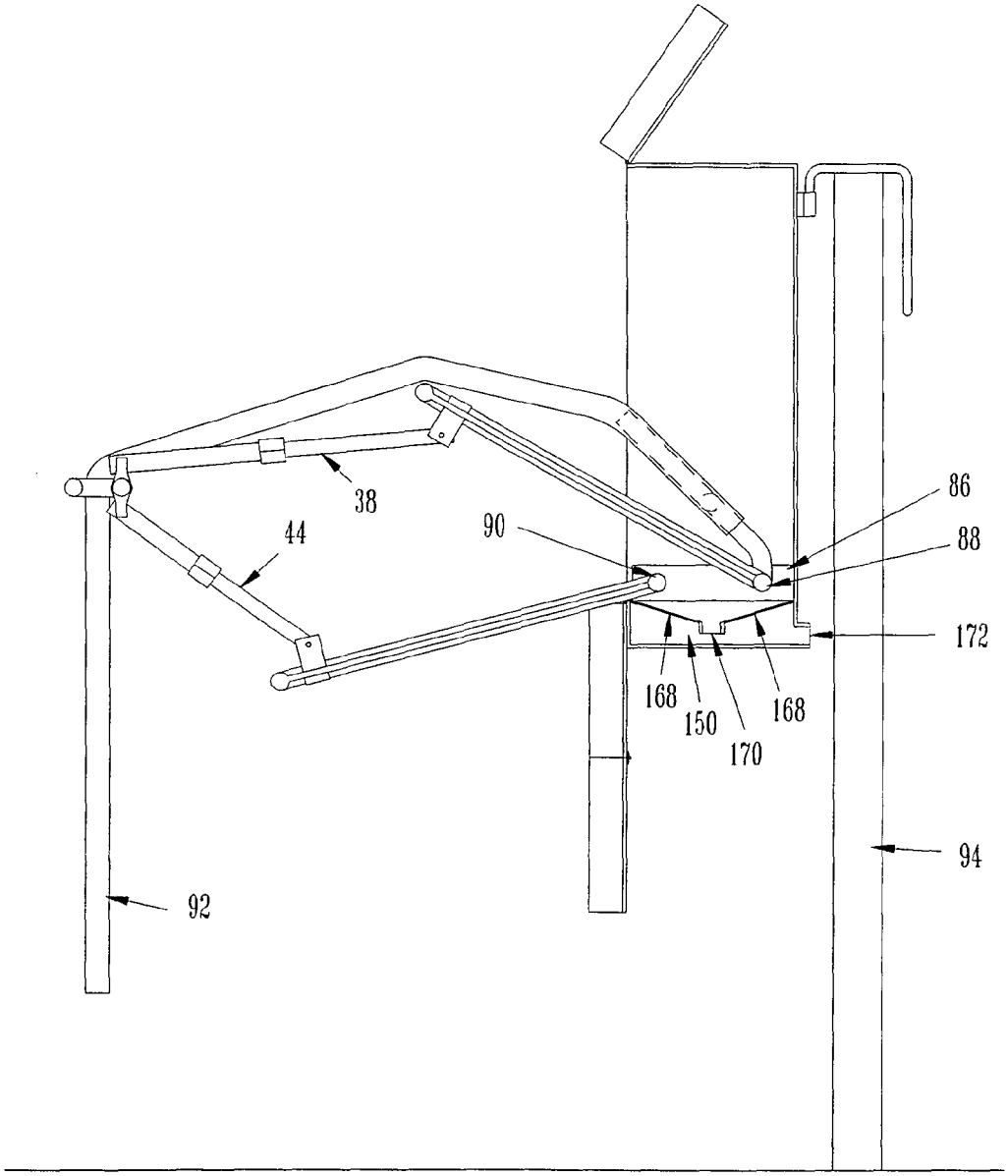
FIG. 15 is a sectional view through 15-15 of FIG. 10 of the wetsuit carrier of FIG. 10.
Figure 16:
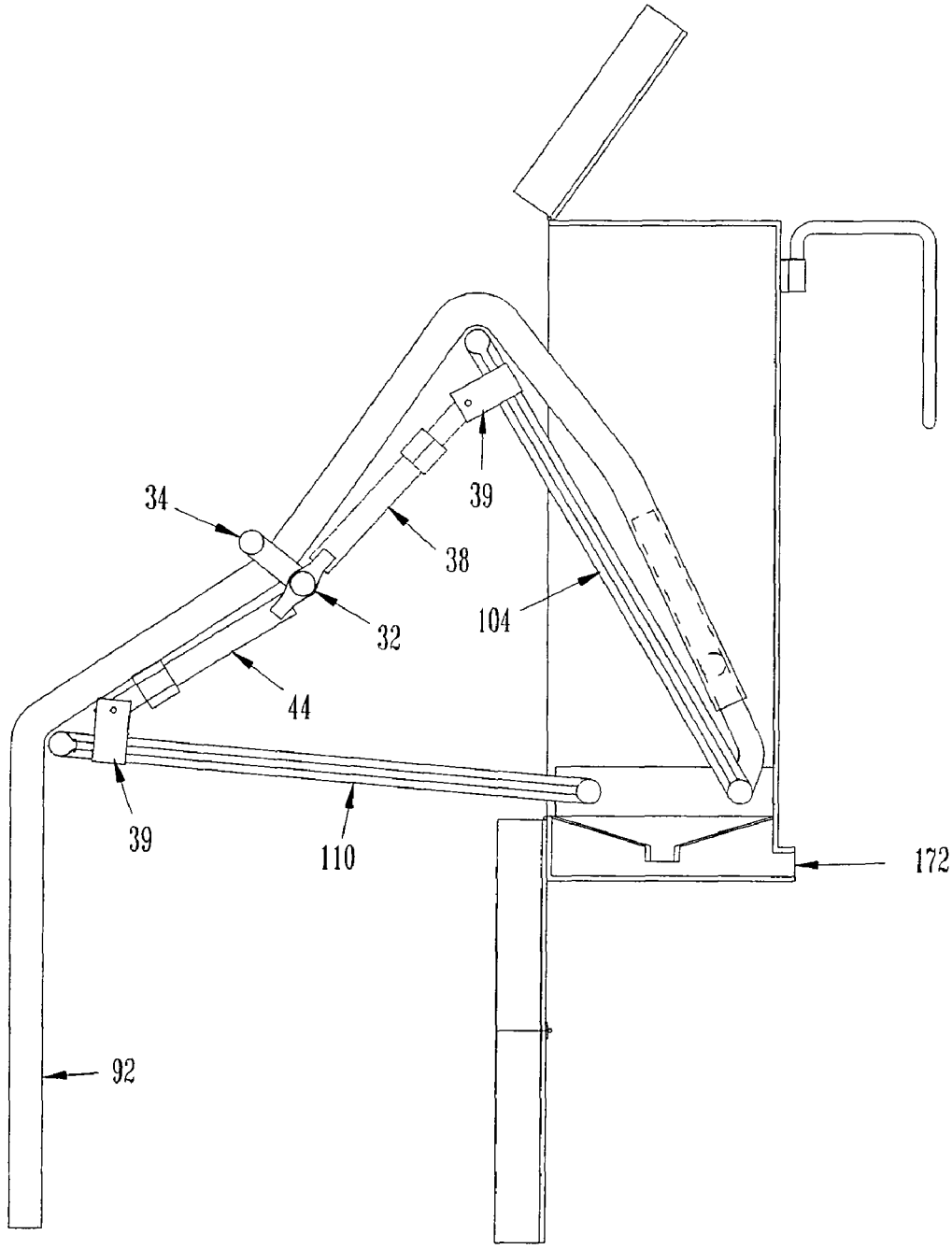
FIG. 16 is a sectional view through 16-16 of FIG. 12 adjusted for a medium sized wetsuit.
Figure 17:
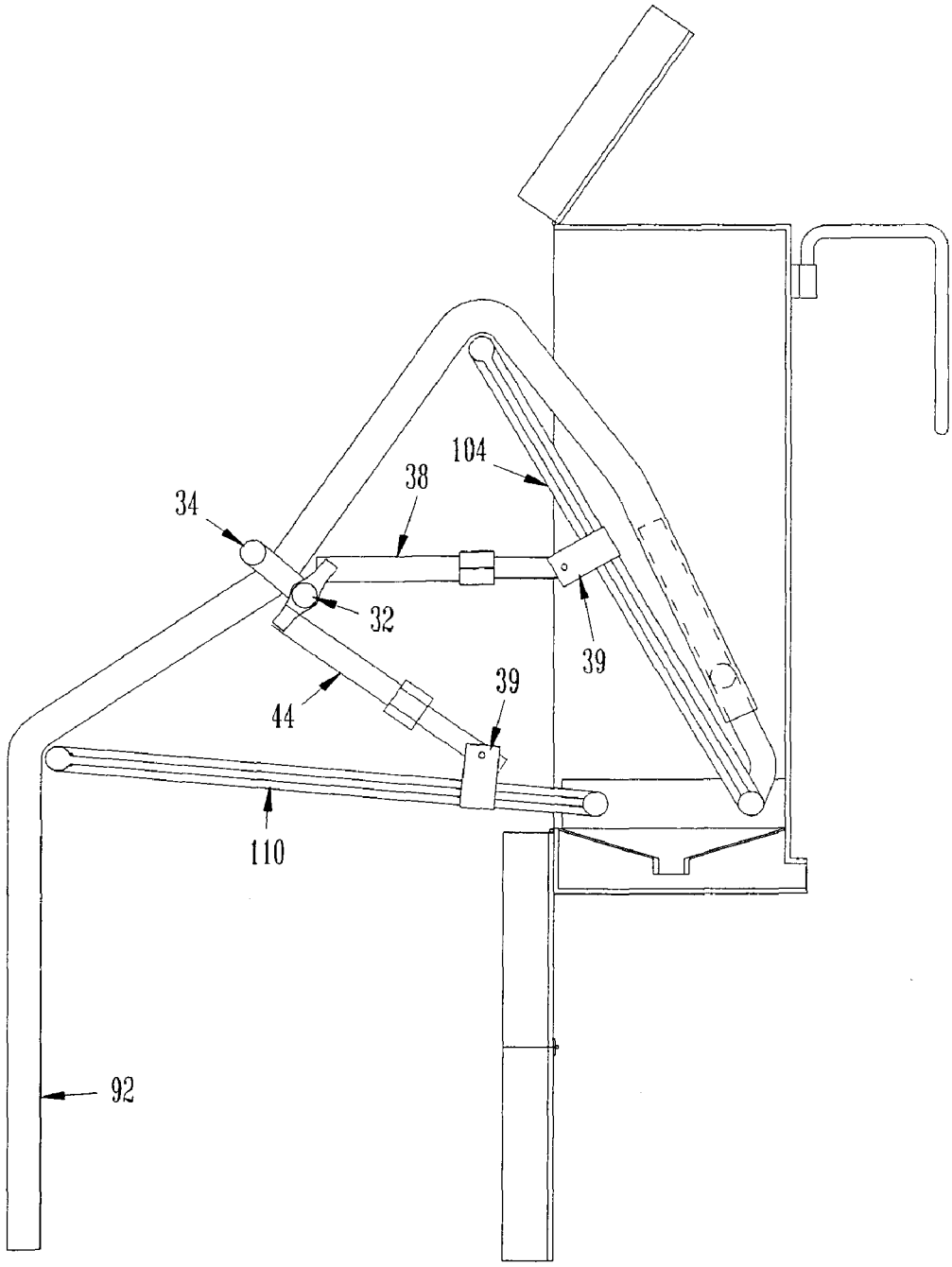
FIG. 17 is similar to FIG. 16 only adjusted for a short wetsuit.
Figure 18:
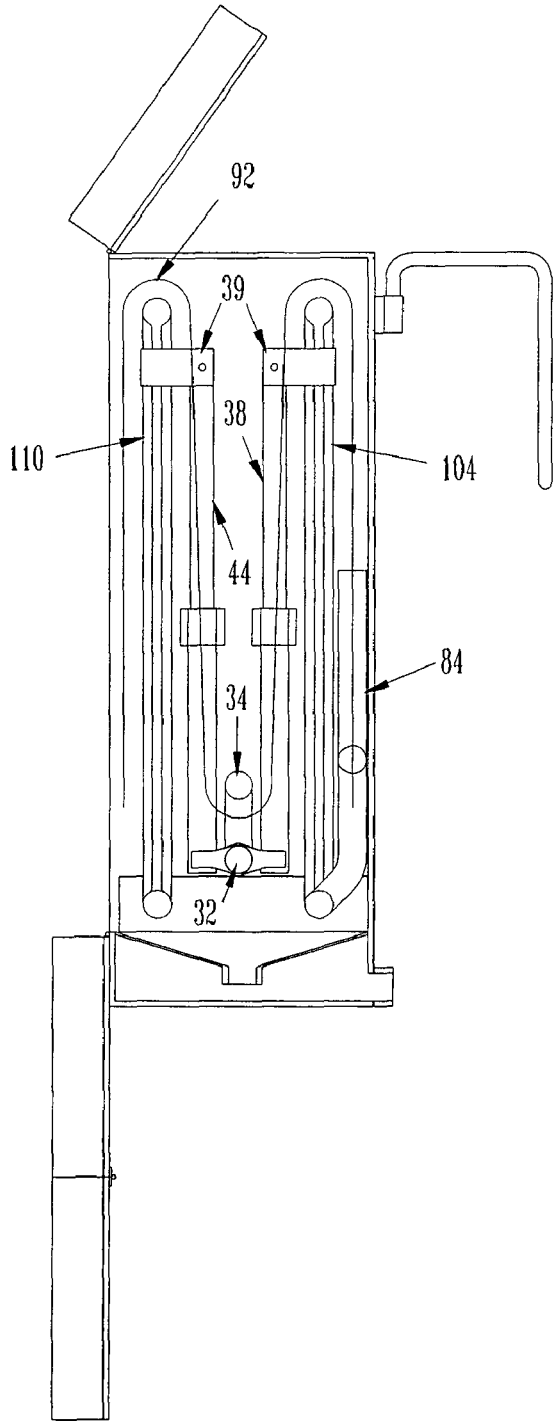
FIG. 18 is a sectional view through 18-18 of FIG. 13 with the carrier configured in the transport mode with a long wetsuit.
Figure 19:
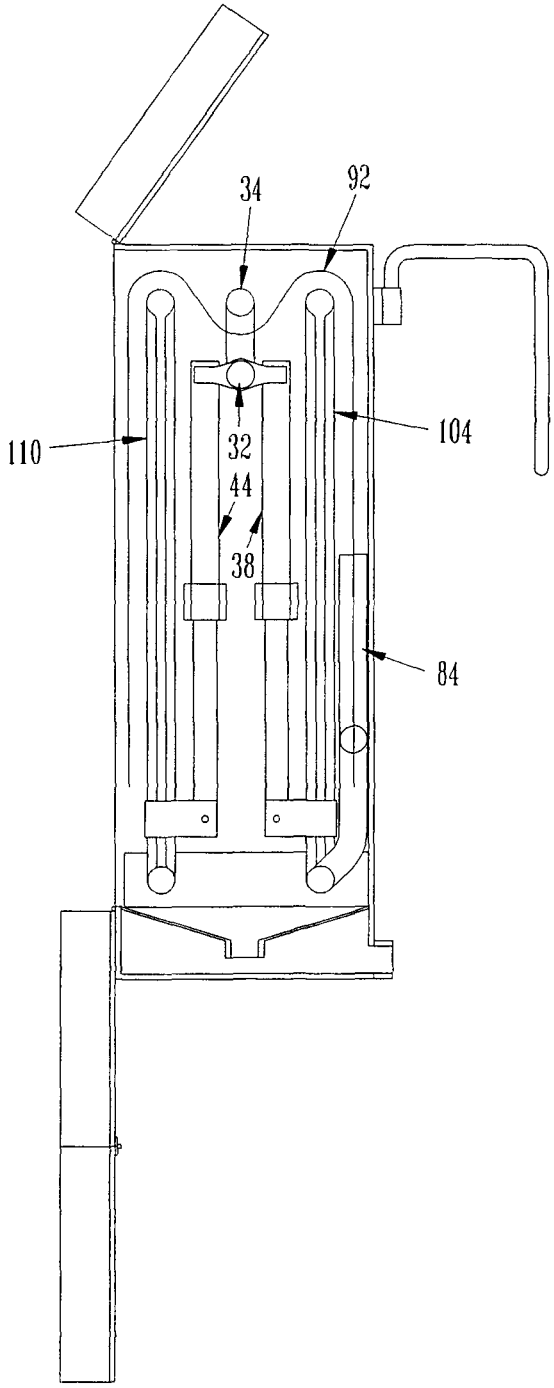
FIG. 19 is a variation of FIG. 18 with the carrier configured in the transport mode with a short wetsuit.

The wetsuit carrying and drying apparatus has two (2) modes, a pretransport drying mode and a transport drying mode. As best seen in FIGS. 11 and 15, the pretransport drying mode, the first and second wetsuit supports 102 and 110 are pivoted out of the wetsuit receiving interior 120. The third support is pivoted away from the first and second supports. The space between the third wetsuit support and the first and second support is adjusted depending on the size of the wetsuit by sliding adjustable clamps 39 up or down periphery of panels 102 and 110. The wetsuit 92 is then mounted on the shoulder support 80. Vertical projections 82 and 84 of the shoulder support engage the shoulders of the wetsuit 92. The wetsuit is pulled across the first wetsuit support and then pulled through a slot 36 in the third wetsuit support. The legs of the wetsuit then are hanging down from the third wetsuit support, desirably, through the slot 36. As a result, when the container is hung from a support such as fence 94 as shown in FIG. 15, the wetsuit 92 is suspended above the ground.

In the transport mode, the first wetsuit support is pivoted into the interior 120 of the container 100. The third wetsuit support is pivoted into the interior 120 of the container 100 beside the first wetsuit support 102. The second wetsuit support 110 is then pivoted into the interior 120 of container 100 beside wetsuit support. As a result the wetsuit 92 is folded into the interior 12 of the container 10 so that each section of wetsuit is suspended and separated from the adjoining folded portion for drying during transportation. Desirably, the wetsuit is folded 3 times to about one-quarter the size of the wetsuit.

The foregoing is considered as illustrative only to the principals of the invention. Further, since numerous changes and modification will occur to those skilled in the art, it is not desired to limit the invention to the exact construction and operation shown and described above, and accordingly, all suitable modifications and equivalents may be resorted to, falling within the scope of the invention.

The invention claimed is:

1. A wetsuit drying and transportation apparatus comprising:

a) a container having i) a wetsuit receiving interior, said interior having a top and bottom; said container having a front having a closeable opening to said wetsuit receiving interior and a back opposed to said front; ii) a cover to close off said opening;

b) a first wetsuit support pivotably connected to said wetsuit receiving interior to pivot into and out of the wetsuit receiving interior;

c) a second wetsuit support pivotably connected to said wetsuit receiving interior between said first wetsuit support and said wetsuit receiving interior to pivot into and out of the interior of said container;

d) a wetsuit shoulder support having a central horizontal portion terminating in vertical projecting ends said wetsuit shoulder support connected to said wetsuit receiving interior or to said first wetsuit support to support the shoulders of a wet suit mounted thereon;

e) a third wetsuit support pivotably connected to said first and second wetsuit support;

f) said third wetsuit support having a slot open at one end and closed at the other end for receipt of a wetsuit through said open end for drying and transport;

g) said apparatus having a pretransport drying mode and a transport mode;

h) in said pretransport drying mode:

1) said first and second wetsuit supports pivoted out of the interior of said container;

2) said third support pivoted away from said first and second support;

3) a wetsuit mounted on said shoulder support so that said wetsuit shoulders are engaged by said support;

4) said wetsuit mounted in said slot;

5) said wetsuit extending across said first support;

whereby said wetsuit is suspended above the ground by said apparatus;

i) in said transport mode:

1) said first wetsuit support pivoted into said interior of said container;

2) said third wetsuit support pivoted into said interior of said container beside said first wetsuit support;

3) said second support pivoted into said interior of said container beside said third wetsuit support;

whereby said wetsuit is folded into said interior of said container so that said wetsuit is suspended in said container for drying during transportation.

2. The wetsuit drying and transportation apparatus according to claim 1 further comprising a reservoir located adjacent to and separate from said interior bottom to receive liquid from said interior.

3. The wetsuit drying and transportation apparatus according to claim 2 wherein said first and second wetsuit supports are connected to said container adjacent to said reservoir.

4. The wetsuit drying and transportation apparatus according to claim 2 further comprising said wetsuit receiving interior bottom having sloping walls to form a trough above said reservoir to direct water from said interior to said reservoir.

5. The wetsuit drying and transportation apparatus according to claim 4 further comprising one or more openings in said trough so water can flow from said interior to said reservoir.

6. The wetsuit drying and transportation apparatus according to claim 2 further comprising;

a first and a second telescoping rod having a top end and a bottom end; said top end of said first telescoping rod attached to an end of said third wetsuit support and said top end of said second telescoping rod attached to the opposite end of said third wetsuit support;

said bottom end of said first telescoping rod attached to a side of said first wetsuit support and said bottom end of said second telescoping rod attached to the opposite side of said first wetsuit support;

a third and a fourth telescoping rod having a top end and a bottom end; said top end of said third telescoping rod attached an end of said third wetsuit support and said top end of said fourth telescoping rod attached to the opposite end of said third wetsuit support;

said bottom end of said third telescoping rod attached a side of said second wetsuit support and said bottom end of said second telescoping rod attached to the opposite side of said second wetsuit support.

7. The wetsuit drying and transportation apparatus according to claim 6 further comprising said first and second telescoping rods pivotably connected to said first wetsuit support by a first and second movable clamp and said third and fourth telescoping rods pivotably connected to said second wetsuit support by a third and fourth movable clamp so that the distance between said third wetsuit support and said first and second wetsuit support can be varied so that a plurality of different size wetsuits can be accommodated.

8. The wetsuit drying and transportation apparatus according to claim 4 further comprising a drain in said reservoir for selectively releasing water from said reservoir.

9. The wetsuit drying and transportation apparatus according to claim 2 wherein said slot in said third support receives said wetsuit at about the midpoint of said wetsuit.

10. The wetsuit drying and transportation apparatus according to claim 2 comprising one or more hangers attached to the back of said wetsuit receiving interior for suspension of said container from a support.

11. The wetsuit drying and transportation apparatus according to claim 10 wherein said support is a fence.

12. The wetsuit drying and transportation apparatus according to claim 2 wherein in said transport mode said wetsuit is folded to less than one half its original length.

13. The wetsuit drying and transportation apparatus according to claim 2 wherein in said transport mode said wetsuit is folded three times to about one quarter its original size.

14. The wetsuit drying and transportation apparatus according to claim 1 wherein said first and said second wetsuit supports are generally solid rectangular supports.

15. The wetsuit drying and transportation apparatus according to claim 1 wherein said closeable opening is substantially watertight when said closable opening is closed.

16. The wetsuit drying and transportation apparatus according to claim 1 further comprising a releasable cover to open and shut said closeable opening.

17. A wetsuit drying and transportation apparatus comprising:

a) a container having i) a wetsuit receiving interior, said interior having a top and bottom; said container having a front having a closeable opening to said wetsuit receiving interior and a back opposed to said front; ii) a cover to close off said opening;

b) a first wetsuit support pivotably connected to said wetsuit receiving interior to pivot into and out of the wetsuit receiving interior;

c) a second wetsuit support pivotably connected to said wetsuit receiving interior between said first wetsuit support and said wetsuit receiving interior to pivot into and out of the interior of said container;

d) a wetsuit shoulder support having a central horizontal portion terminating in vertical projecting ends said wetsuit shoulder support connected to said container or to said first wetsuit support to support the shoulders of a wet suit mounted thereon;

e) a third wetsuit support pivotably connected to said first and second wetsuit support;

f) said third wetsuit support having a slot open at one end and closed at the other end for receipt of a wetsuit through said open end for drying and transport;

g) a reservoir located adjacent to and separate from said interior bottom to receive liquid from said interior;

h) a first and a second telescoping rod having a top end and a bottom end; said top end of said first telescoping rod attached to an end of said third wetsuit support and said top end of said second telescoping rod attached to the opposite end of said third wetsuit support;

i) said bottom end of said first telescoping rod attached to a side of said first wetsuit support and said bottom end of said second telescoping rod attached to the opposite side of said first wetsuit support;

j) a third and a fourth telescoping rod having a top end and a bottom end; said top end of said third telescoping rod attached an end of said third wetsuit support and said top end of said fourth telescoping rod attached to the opposite end of said third wetsuit support;

k) said bottom end of said third telescoping rod attached a side of said second wetsuit support and said bottom end of said second telescoping rod attached to the opposite side of said second wetsuit support l) said apparatus having a pretransport drying mode and a transport mode;

m) in said pretransport drying mode:

1) said first and second wetsuit supports pivoted out of the interior of said container;

2) said third support pivoted away from said first and second support;

3) a wetsuit mounted on said shoulder support so that said wetsuit shoulders are engaged by said support;

4) said wetsuit mounted in said slot;

5) said wetsuit extending across said first support;

whereby said wetsuit is suspended above the ground by said apparatus;

o) in said transport mode:

1) said first wetsuit support pivoted into said interior of said container;

2) said third wetsuit support pivoted into said interior of said container beside said first wetsuit support;

3) said second support pivoted into said interior of said container beside said third wetsuit support;

whereby said wetsuit is folded into said interior of said container so that said wetsuit is suspended in said container for drying during transportation.

18. The wetsuit drying and transportation apparatus according to claim 17 further comprising said first and second telescoping rods pivotably connected to said first wetsuit support by a first and second movable clamp and said third and fourth telescoping rods pivotably connected to said second wetsuit support by a third and fourth movable clamp so that the distance between said third wetsuit support and said first and second wetsuit support can be varied so that a plurality of different size wetsuits can be accommodated.

* * * * *